US007451093B2

(12) United States Patent
Kraemer

(10) Patent No.: US 7,451,093 B2
(45) Date of Patent: Nov. 11, 2008

(54) SYSTEMS AND METHODS OF REMOTELY ENABLING SOUND ENHANCEMENT TECHNIQUES

(75) Inventor: Alan D. Kraemer, Irvine, CA (US)

(73) Assignee: SRS Labs, Inc., Santa Ana, CA (US)

( * ) Notice: Subject to any disclaimer, the term of this patent is extended or adjusted under 35 U.S.C. 154(b) by 762 days.

(21) Appl. No.: 10/936,914

(22) Filed: Sep. 9, 2004

(65) Prior Publication Data

US 2005/0246179 A1 Nov. 3, 2005

Related U.S. Application Data

(60) Provisional application No. 60/566,340, filed on Apr. 29, 2004.

(51) Int. Cl.
*G10L 19/00* (2006.01)

(52) U.S. Cl. ..... 704/500; 381/23; 381/307

(58) Field of Classification Search ..... 381/23, 381/307; 704/500
See application file for complete search history.

(56) References Cited

U.S. PATENT DOCUMENTS 5,870,480 A * 2/1999 Griesinger ..... 381/18
6,430,301 B1 8/2002 Petrovic
6,614,914 B1 9/2003 Rhoads et al.
6,624,873 B1 * 9/2003 Callahan, Jr. et al. ..... 352/27
6,737,957 B1 5/2004 Petrovic et al.
6,760,448 B1 * 7/2004 Gundry ..... 381/23
7,212,872 B1 * 5/2007 Smith et al. ..... 700/94
2001/0020193 A1 9/2001 Kazuhiko et al.
2002/0129151 A1 9/2002 Thomas et al.
2002/0157005 A1 10/2002 Brunk et al.
2003/0185418 A1 * 10/2003 Linnartz et al. ..... 382/100
2005/0078851 A1 * 4/2005 Jones et al. ..... 382/100
2007/0025842 A1 * 2/2007 Bouru ..... 415/160

FOREIGN PATENT DOCUMENTS

WO WO 01/61987 8/2001

OTHER PUBLICATIONS

Boney L. et al., "Digital Watermarks for Audio Signals", Proceedings of the International Conference on Multimedia Computing and Systems, Los Alamitos, Ca, US; Jun. 17, 1996, pp. 473-480.

* cited by examiner

*Primary Examiner*—Daniel D Abebe
(74) *Attorney, Agent, or Firm*—Knobbe Martens Olson & Bear, LLP

(57) ABSTRACT

A system and method of remotely enabling sound enhancement techniques is disclosed. In an embodiment, a watermark is embedded in an encoded multi-channel audio stream to remotely enable an enhancement decoder portion of a multi-channel audio decoder.

28 Claims, 3 Drawing Sheets

SYSTEMS AND METHODS OF REMOTELY ENABLING SOUND ENHANCEMENT TECHNIQUES

RELATED APPLICATIONS

The present application claims priority benefits under 35 USC § 119(e) from U.S. Provisional Application No. 60/566,340, filed Apr. 29, 2004, entitled "SYSTEMS AND METHODS OF REMOTELY ENABLING SOUND ENHANCEMENT TECHNIQUES", the entirety of which is hereby incorporated herein by reference.

BACKGROUND OF THE INVENTION

1. Field of the Invention

The present invention relates to a method and system for controlling audio enhancement techniques to decode enhanced audio. In particular, the invention relates to using an enhanced audio signal to remotely control an audio decoder.

2. Description of the Related Art

Digital watermarking is a process for modifying physical or electronic media to embed a machine-readable code into the media. The media may be modified such that the embedded code is imperceptible or nearly imperceptible to the user. Most commonly, digital watermarking is applied to media signals such as images, audio signals, and video signals.

Digital watermarking systems typically have two primary components: an encoder that embeds the watermark in the host media signal, and a decoder that detects and reads the embedded watermark from a signal suspected of containing a watermark. The encoder embeds a watermark by altering the host media signal. The decoder analyzes a suspect signal to detect whether a watermark is present. In applications where the watermark encodes information, the decoder extracts this information from the detected watermark.

When the host media is an audio signal, watermarking embeds auxiliary data in a host audio signal. One feature of some audio watermarking techniques is that the embedded signal is substantially imperceptible to a listener of the host signal.

SUMMARY OF THE INVENTION

There exist many audio-enhancing techniques to spatially enhance a stereo image with respect to a listener when the enhanced audio is played through a speaker system. In one such example, a matrix system encodes a three or more channels or audio signals down to a two channel stereo signal. Examples of matrix encoding techniques include, but are not limited to, Left Center, Right, Surround (LCRS), 5.1, 6.1, 7.1, and the like. In an embodiment, a recorder records the encoded stereo signal and a playback device plays the encoded stereo signal.

In another embodiment, a transmitter transmits the encoded stereo signal and a receiver receives the encoded stereo signal. The receiver or playback device decodes the encoded two-channel stereo signal into the at least three channels to allow placement of specific sounds at any one of three or more predetermined locations.

Since matrix encoding can not often be reliably detected from the audio itself, a watermark can be incorporated into the matrix-encoded audio. In an embodiment of the invention, a watermark encoder embeds a watermark in a multi-channel audio signal. A matrix encoder then encodes the multi-channel audio signal as a two-channel audio signal.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements.

DETAILED DESCRIPTION OF THE PREFERRED EMBODIMENTS

Figure 1:
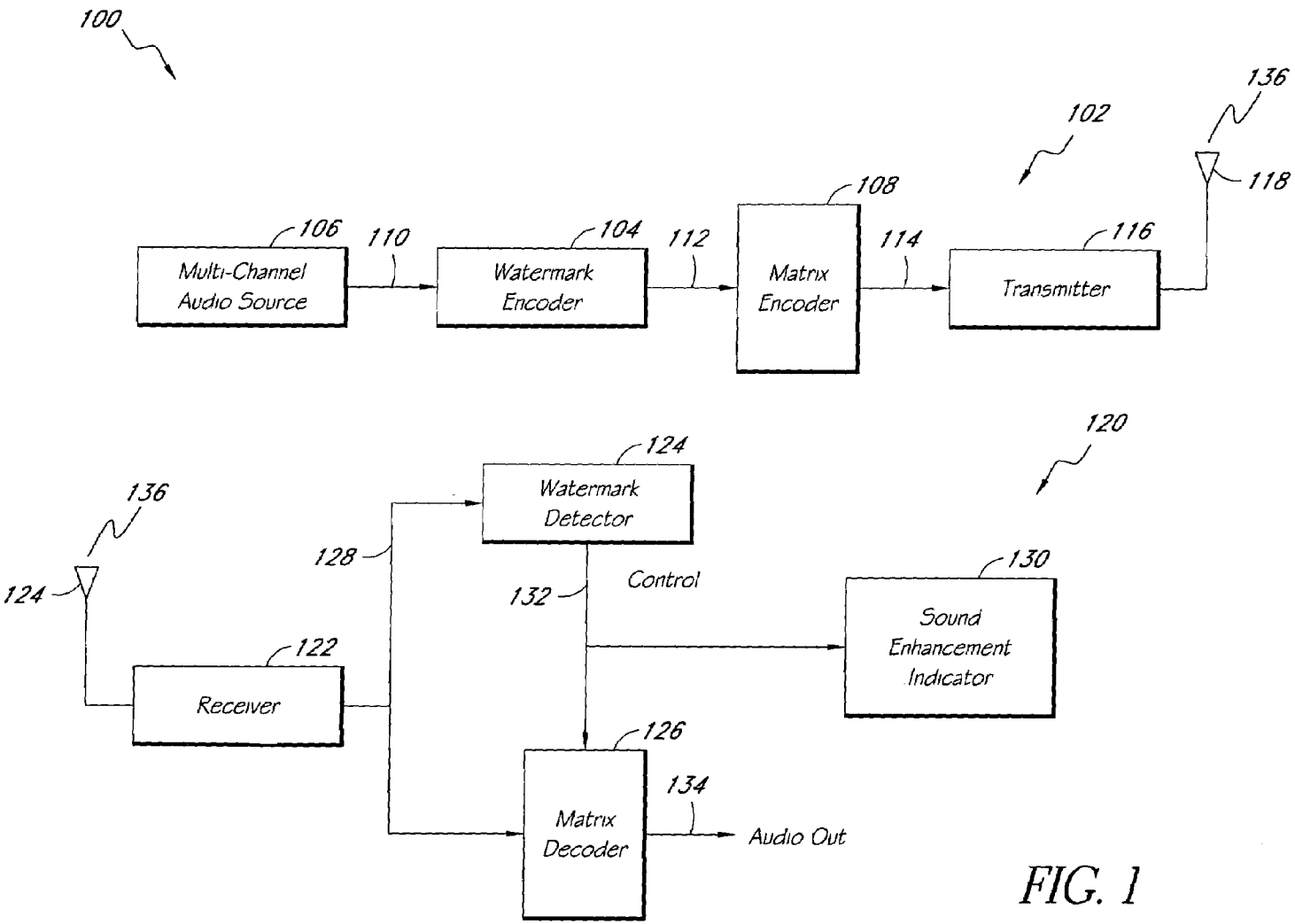
FIG. 1 illustrates a system to identify and decode an enhanced audio technique, according to an embodiment of the invention.

For a more detailed understanding of the invention, reference is first made to FIG. 1. FIG. 1 illustrates an embodiment of a system 100 for using a watermark embedded in a multi-channel audio signal to remotely control a matrix decoder.

At an encoding portion 102, a watermark encoder 104 embeds a watermark in multi-channel audio 110 from a multi-channel audio source 106. The watermark comprises a control message to activate an enhancement decoder of an audio decoder 126 at a decoding portion 120.

In an embodiment, the watermark encoder 104 embeds a watermark in at least one channel of the multi-channel audio 110. In another embodiment, the watermark encoder 104 embeds a watermark in a portion of the channels of the multi-channel audio signal 110. In a further embodiment, the watermark encoder 104 embeds a watermark in each channel of the multi-channel audio 110. The multi-channel audio format can be either digital or analog.

The system 100 is compatible with watermarking technologies that use audio channels to carry data without interfering with the audio channel's original purpose. A watermark is a pattern of data that can be detected. In one embodiment, a watermark includes adding a pattern of tones, a pattern of bits, or often information that is not easily noticeable.

The watermark encoder 104 embeds a watermark in the multi-channel audio 110 using a key. The key is a set of parameters that define the watermarking process and is used in a decoder to decode the watermark message. The watermark encoder 104 may provide the watermark in the multi-channel audio signal 110 using various known watermarking principles, such as, for example bitplane techniques, transform techniques, format based techniques, and the like. For example, the watermark encoder 104 can use commercially available watermarking technology provided by Verance Corporation. An example of watermarking technology is disclosed in U.S. Pat. No. 6,737,957, by Petrovic et al. and assigned to Verance Corporation, which is herein incorporated herein in its entirety by reference.

Typical bit rates of watermark messages are low, ranging from less than a bit per second to a few tens of bits per second. In an embodiment, the watermark encoder 104 encodes the watermark at least once every three seconds. In another embodiment, the bit rate is less than 10 bits per second. In a further embodiment, the bit rate is greater than 10 bits per second.

The watermark encoder 104 produces a composite audio signal 112, which comprises the multi-source audio 110 with the watermark embedded in one, all, or a portion of the audio channels.

A matrix encoder 108 receives the composite audio signal 112 from the watermark encoder 104. The matrix encoder 108 encodes and enhances the composite audio signal 112 into a two-channel audio signal 114 comprising the watermark. The matrix encoder 108 may use various signal processing techniques, such as, for example, compression, coding, error-correction, modulation, filtering, frequency shifting, time delay, integration, differentiation, summing, subtracting, and the like, as are known to one of skill in the art of audio signal processing. In an embodiment, the matrix encoder 108 is a surround sound encoder. In a further embodiment, the matrix encoder 108 is a Circle Surround encoder.

A transmitter 116 receives the two-channel audio signal 114 for broadcasting the two-channel audio signal 114 as an audio transmission 136 via an antenna 118. Although the embodiment illustrated in FIG. 1 shows the transmitter 116 and the antenna 118, any type of broadcast scheme can be used, including AM, FM, broadband, cable, optical fiber, computer network, analog transmission, digital transmission, land line, and the like.

In another embodiment, the two-channel audio signal 114 is stored on digital media, such as, for example a compact disc (CD), a digital video disc (DVD), a super audio CD, a solid state memory device, such as EEPROM, EPROM, PROM, ROM, RAM, or the like. In another embodiment, the two-channel audio signal 114 is stored on analog media, such as, for example, a magnetic tape, or the like.

At the decoding portion 120 of the system 100, a receiver 122 receives the audio transmission 136 via an antenna 124. The receiver 122 and antenna 124 transform the audio transmission 136 into a two-channel audio signal 128 corresponding to the two-channel audio signal 114.

In other embodiments, the receiver 122 may be a receiver designed for other broadcast schemes, such as a receiver for AM, FM, broadband, cable, optical fiber, computer network, analog transmission, digital transmission, and the like.

In another embodiment, the receiver 122 is a playback device for receiving the two-channel audio signal 128 from the storage device storing the two-channel audio signal 114. Examples of storage devices include CD's, DVD's, solid state memory, magnetic tape, and the like.

The decoding portion 120 further comprises a watermark detector 138. The watermark detector 138 receives the two-channel audio signal 128. Using the key and conventional watermark detection algorithms, the watermark detector 138 detects and decodes the watermark embedded in the two-channel audio signal 128. The watermark comprises information pertaining to the encoded and enhanced audio of the two-channel audio signal 128. In an embodiment, the watermark message identifies the encoded and enhanced audio as a surround sound encoded audio stream. In a further embodiment, the watermark message identifies the encoded and enhanced audio as a Circle Surround encoded audio stream. Further, the watermark detector 138 enables a control signal 132.

The decoding portion 120 further comprises the matrix decoder 126. In an embodiment, the matrix decoder 126 further comprises an enhancement decoder portion. The matrix decoder 126 may use various signal processing techniques, such as, for example, decompression, coding, error-correction, de-modulation, filtering, frequency shifting, time delay, integration, differentiation, summing, subtracting, and the like, as are known to one of skill in the art of audio signal processing to decode the two-channel audio signal 128.

The matrix decoder 126 receives the two-channel audio signal 128 and the control signal 132. The control signal 132 activates the enhancement decoder portion of the matrix decoder 126 in the correct mode to correctly decode the encoded and enhanced two-channel audio signal 128. The matrix decoder 126 decodes the two-channel audio signal 128 to produce a decoded audio output 134. In an embodiment, the matrix decoder 126 is a surround sound matrix decoder. In a further embodiment, the matrix decoder 126 is a Circle Surround matrix decoder.

The decoding portion 120 further comprises an indicator 130. The indicator 130 receives the control signal 132. The control signal 132 activates the indicator 130 to indicate that the receiver 122 is receiving an encoded and enhanced audio signal, which the enhancement decoder portion of the matrix decoder 126 is capable of decoding. Typically, the indicator 130 comprises a visual indicator, such as, for example, a lamp, a light emitting diode (LED), a liquid crystal display (LCD), or the like. In an embodiment, the indicator 130 indicates that the receiver 122 is receiving a surround sound encoded audio stream. In a further embodiment, the indicator 130 indicates that the receiver 122 is receiving a Circle Surround encoded audio stream.

In an embodiment where the audio transmission 136 is audio without an embedded watermark, the watermark detector 138 receives the two-channel encoded audio signal 128, and determines that the watermark is absent. In the absence of a watermark for a predetermined period of time, the watermark detector 138 generates the control signal 132 indicating that the audio is not enhanced audio. The control signal 132 deactivates the enhancement decoder portion of the matrix decoder 126 and deactivates the enhanced audio indicator 130.

In an embodiment, the predetermined period of time is approximately 3 seconds. In another embodiment, the predetermined period of time is less than 10 milliseconds. In a further embodiment, the predetermined period of time is more than 3 seconds. In a yet further embodiment, the predetermined period of time is between approximately 10 milliseconds and 3 seconds.

The predetermined amount of time depends on the application. For example, once a song on a CD has started to play, the watermark does not need to be repeated throughout the song, as it is likely that the audio encoding technique used to enhance the audio was used throughout the entire song. In this example, the watermark may be absent for tens of seconds.

In another example, while the audio for a television program may be enhanced, the audio for the commercials played throughout the television program may not be enhanced. In this example, the absence of the watermark for a few milliseconds indicates that audio for a commercial, which is not enhanced audio, is being played through the speaker system and that it is desirable to disable the enhancement decoder portion of the audio decoder.

In an embodiment where the matrix encoder 108 is a Circle Surround matrix encoder, and the matrix decoder 126 is a Circle Surround matrix decoder, the audio transmission 136 is a Circle Surround encoded audio stream. The Circle Surround encoded audio stream 136 comprises the embedded watermark, which contains the information that the audio signal is Circle Surround audio. The receiver 122 receives the transmission 136 and converts the transmission 136 into the two-channel encoded Circle Surround audio signal 128. The watermark detector 138 receives the two-channel encoded Circle Surround audio signal 128, decodes the watermark, and generates the control signal 132 indicating that the audio is Circle Surround audio. The control signal 132 activates the Circle Surround matrix decoder 126 and the Circle Surround indicator 130. The Circle Surround matrix decoder 126 de-matrixes and decodes the two-channel encoded and enhanced Circle Surround audio 128. The audio output 134 comprises multi-channel enhanced audio.

In an embodiment where the matrix encoder 108 is other than a Circle Surround matrix encoder and the matrix decoder 126 is a Circle Surround matrix decoder, the audio transmission 136 is encoded audio with an embedded watermark indicating the audio is not Circle Surround encoded. The receiver 122 receives the transmission 136 and converts the transmission 136 into the two-channel encoded audio signal 128. The watermark detector 138 receives the two-channel encoded audio signal 128, decodes the watermark, and generates the control signal 132 indicating that the audio is not Circle Surround audio. The control signal 130 deactivates the Circle Surround mode of the matrix decoder 126 and deactivates the Circle Surround indicator 130. In an embodiment, the Circle Surround matrix decoder 126 does not de-matrix the two-channel encoded audio signal 128. The audio output 134 comprises the two-channel audio signal 128. In another embodiment, the Circle Surround matrix decoder 126 processes the two-channel audio signal 128 to provide a two-channel output signal at the audio output 134. In another embodiment, the Circle Surround matrix decoder 126 de-matrixes the audio, but does not decode the audio enhancement.

In an embodiment where the matrix encoder 108 is other than a Circle Surround matrix encoder and the matrix decoder 126 is a Circle Surround matrix decoder, the audio transmission 136 is encoded audio without an embedded watermark. The receiver 122 receives the transmission 136 and converts the transmission 136 into the two-channel encoded audio signal 128. The watermark detector 138 receives the two-channel encoded audio signal 128, and determines that the watermark is absent. In the absence of a watermark for a predetermined period of time, the watermark detector generates the control signal 132 indicating that the audio is not Circle Surround audio.

In an embodiment, the predetermined period of time is approximately 3 seconds. In another embodiment, the predetermined period of time is less than 10 milliseconds. In a further embodiment, the predetermined period of time is more than 3 seconds. In a yet further embodiment, the predetermined period of time is between approximately 10 milliseconds and 3 seconds.

The control signal 132 deactivates the Circle Surround mode of the matrix decoder 126 and deactivates the Circle Surround indicator 130. In an embodiment, the Circle Surround matrix decoder 126 does not de-matrix the two-channel encoded audio signal 128. The audio output 134 comprises the two-channel audio signal 128. In another embodiment, the Circle Surround matrix decoder 126 processes the two-channel audio signal 128 to provide a two-channel output signal at the audio output 134. In another embodiment, the Circle Surround matrix decoder 126 de-matrixes the audio, but does not decode the audio enhancement.

Figure 2:
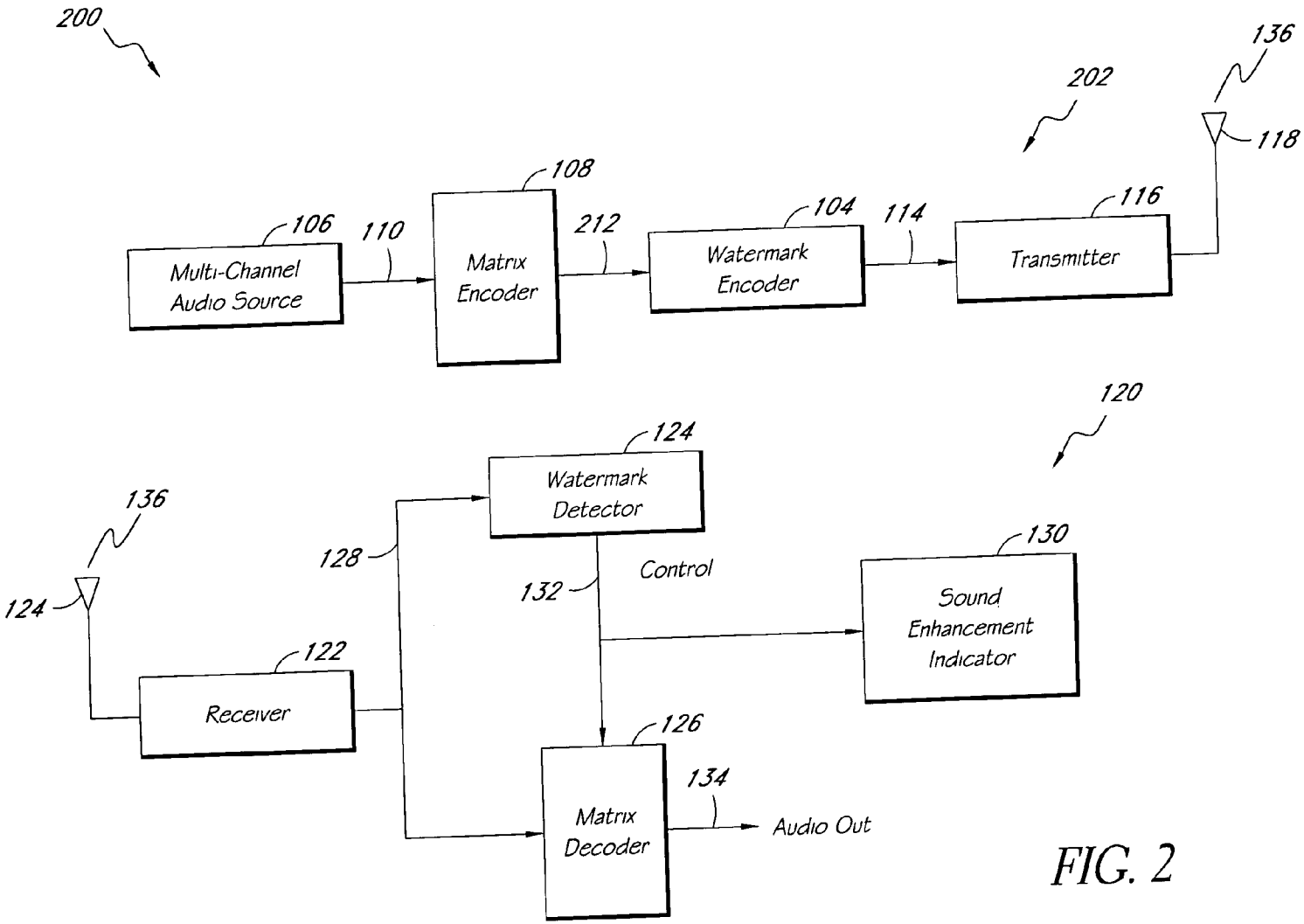
FIG. 2 illustrates a system to identify and decode an enhanced audio technique, according to another embodiment of the invention.

FIG. 2 illustrates another embodiment of a system 200 for using a watermark embedded in a multi-channel audio signal to remotely control a matrix decoder.

At an encoding portion 202, the matrix encoder 108 receives the multi-channel audio signal 110 from the multi-channel audio source 106. The matrix encoder 108 encodes and enhances the multi-channel audio signal 110 into a two-channel audio signal 212. The matrix encoder 108 may use various signal processing techniques, such as, for example, compression, coding, error-correction, modulation, filtering, frequency shifting, time delay, integration, differentiation, summing, subtracting, and the like, as are known to one of skill in the art of audio signal processing. In an embodiment, the matrix encoder 108 is the surround sound encoder. In a further embodiment, the matrix encoder 108 is the Circle Surround encoder.

The watermark encoder 104 receives the encoded and enhanced two-channel audio signal 212 from the matrix encoder 108 and embeds a watermark in the two-channel audio signal 212. The watermark comprises a control message to activate the enhancement decoder of the matrix decoder 126 at the decoding portion 120.

In an embodiment, the watermark encoder 104 embeds a watermark in at least one of the channels of the two-channel audio signal 212. The two-channel audio format can be either digital or analog. The watermark encoder 104 produces the watermarked two-channel audio signal 114, which comprises the encoded and enhanced two-channel audio signal 212 and the watermark embedded in one or both of the audio channels.

The transmitter 116 receives the watermarked two-channel audio signal 114 for broadcasting the watermarked two-channel audio signal 114 as the audio transmission 136 via the antenna 118.

In another embodiment, the watermarked two-channel audio signal 114 is stored on digital media, such as, for example a compact disc (CD), a digital video disc (DVD), a super audio CD, a solid state memory device, such as EEPROM, EPROM, PROM, ROM, RAM and the like. In another embodiment, the two-channel audio signal 114 is stored on analog media, such as, for example, a magnetic tape, or the like.

The decoding portion 120 of the system 200 is the same as the decoding portion 120 of the system 100, shown in FIG. 1 and described above.

As illustrated in FIGS. 1 and 2, the watermark can be inserted in the multi-channel audio 110 prior to encoding and enhancing the audio, or the watermark can be inserted into the encoded two-channel audio 212 after encoding and enhancing the audio.

Figure 3:
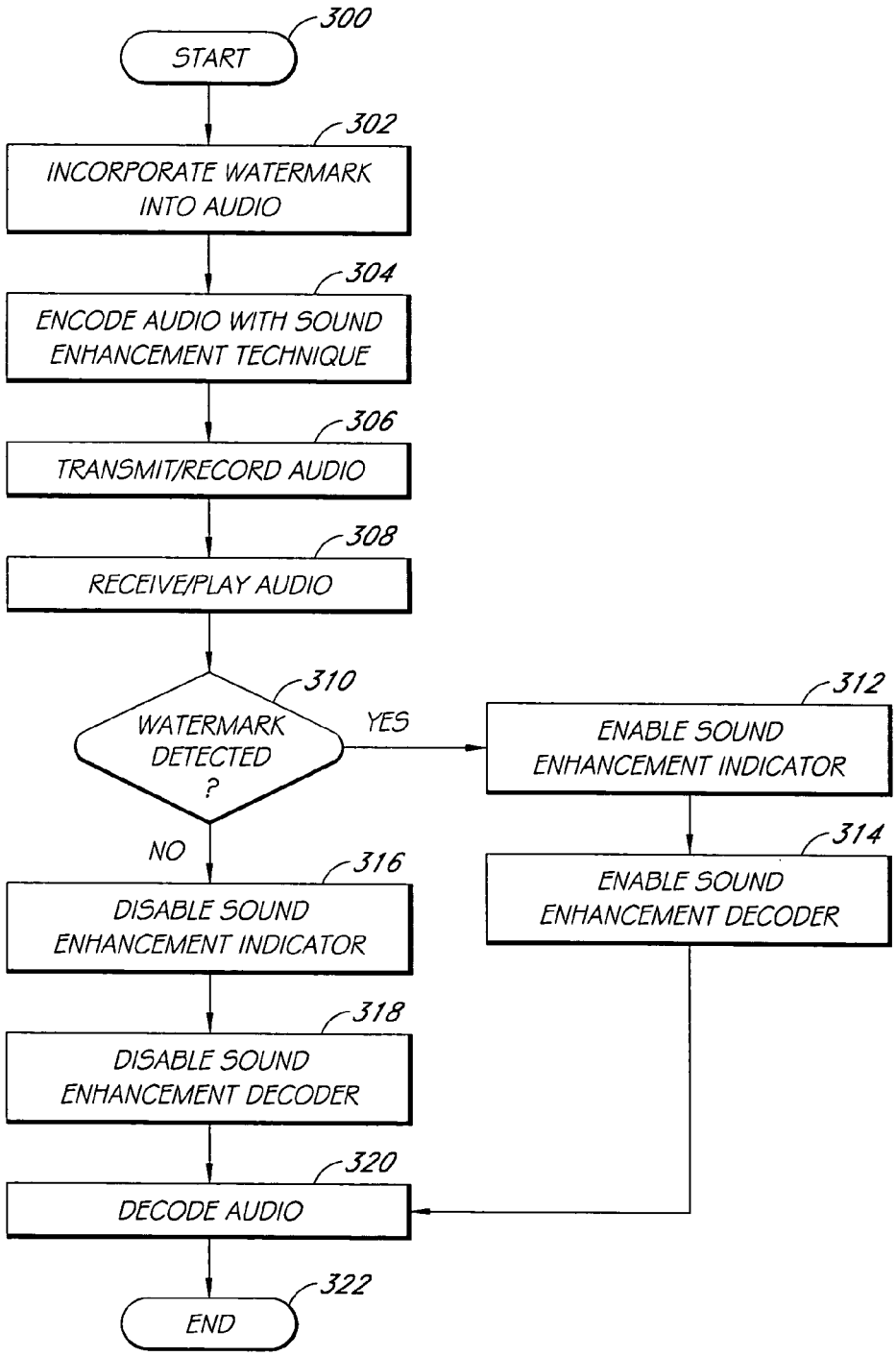
FIG. 3 is a flow diagram illustrating a method of identifying and decoding an enhanced audio technique, according to an embodiment of the invention.

FIG. 3 illustrates a process of identifying and decoding an enhanced audio technique, according to an embodiment of the invention.

Beginning at block 302, the watermark encoder 104 incorporates a watermark into the multi-channel audio 110. In block 304, the matrix encoder 108 encodes and enhances the multi-channel audio with the embedded watermark 112 into the watermarked two-channel audio 114.

In another embodiment, illustrated in FIG. 2, the steps of embedding a watermark 302, and encoding and enhancing 304 are performed in the reverse order. The matrix encoder 108 encodes and enhances the multi-channel audio 110 into the encoded and enhanced two-channel audio 212 prior to the watermark encoder 104 embedding a watermark in the encoded and enhanced two-channel audio 212.

In an embodiment, the matrix encoder 108 is a surround sound matrix encoder, which encodes and enhances the multi-channel audio signal 110, 112 into the encoded and enhanced two-channel audio signal 114, 212. In a further embodiment, the matrix encoder 108 is a Circle Surround matrix encoder, which encodes and enhances the multi-channel audio signal 110, 112 into the encoded and enhanced two-channel audio signal 114, 212.

Referring to FIG. 3, in block 306, the transmitter 116 transmits the watermarked two-channel audio transmission 136 to the receiver 122. In another embodiment, the watermarked two-channel audio signal 114 can be stored on the storage device for playback at the receiver 122.

In block 308, the receiver 122 receives the watermarked two-channel audio transmission 136. The receiver 122 and the antenna 124 convert the transmission 136 into the two-channel audio signal 128. In another embodiment, the receiver 122 plays the stored watermarked two-channel audio signal 128 from the storage device.

In block 310, the watermark detector 138 receives the watermarked two-channel audio signal 128 and retrieves the watermark from the signal 128. The watermark detector 138 generates the control signal 132 indicative of the decoded watermark.

In block 312, the control signal 132 activates the indicator 130. The indicator 130 indicates that the receiver 122 is receiving encoded audio that can be decoded in the enhancement decoder portion of the matrix decoder 126.

In block 314, the control signal 130 activates the enhancement decoder portion of the matrix decoder 126 to decode the encoded two-channel audio signal 128.

In block 320, the activated matrix decoder 126 de-matrixes and decodes the encoded and enhanced two-channel audio signal 128 into the multi-channel enhanced output audio 134.

In an embodiment, the matrix decoder 126 is a surround sound matrix decoder, which de-matrixes the audio and decodes the audio enhancement encoded by the surround sound matrix encoder into the multi-channel enhanced audio output 134.

In a further embodiment, the matrix decoder 126 is a Circle Surround matrix decoder, which de-matrixes the audio and decodes the audio enhancement encoded by the Circle Surround matrix encoder into the multi-channel enhanced audio output 134.

In block 316, the control signal 132 deactivates the indicator 130. In block 318, the control signal 130 deactivates the enhancement decoder portion of the matrix decoder 126.

In block 320, in an embodiment, the matrix decoder 126 with the deactivated enhancement decoder portion outputs the encoded two-channel audio signal 128 as the audio output 134. In another embodiment, the matrix decoder 126 processes the encoded two-channel audio signal to produce the audio output 134. In another embodiment, the matrix decoder 126 de-matrixes the audio, but does not decode the audio enhancement.

The process ends at block 322.

Other Embodiments

In another embodiment, the matrix encoder 108 encodes the multi-channel audio signal as a two-channel audio signal. The watermark encoder 104 then embeds the watermark in the two-channel audio signal.

In an embodiment, the transmitter 116 digitally transmits the two-channel audio signal to the receiver 122. In another embodiment, the transmitter 116 transmits the two-channel audio signal as an analog signal to the receiver 122. In a further embodiment, a recorder records the two-channel audio signal on digital media for playback at the audio receiver 122. In yet another embodiment, a recorder records the two-channel audio signal on analog media for playback at the audio receiver 122.

In another embodiment, the receiver 122 receives the two-channel audio signal. The receiver 122 detects the watermark and activates the enhancement decoder portion of the matrix decoder 126 in response to detecting the watermark. The matrix decoder 126 decodes the two-channel audio signal into the multi-channel enhanced audio signal for playback through a speaker system. In an embodiment, the receiver 122 enables the indicator 130 in response to detecting the watermark.

In another embodiment, the absence of the watermark deactivates the enhancement decoder portion of the matrix decoder 126 and disables the indicator 130. The two-channel audio signal is then available for playback through the speaker system In an embodiment, a method of identifying a surround sound audio technique in an encoded audio stream comprises encoding with the surround sound matrix encoder 108 multi-channel audio into two-channel audio, and embedding a watermark in the two-channel audio, where the watermark identifies the audio as surround sound matrix encoded audio.

In another embodiment, a method of identifying a surround sound audio encoding technique in an audio stream comprises embedding a watermark in multi-channel audio, where the watermark identifies the audio as surround sound matrix encoded audio, and encoding with the surround sound matrix encoder 108 the multi-channel audio having the embedded watermark into two-channel audio.

In another embodiment, a method of identifying a surround sound audio technique in an encoded audio stream comprises receiving two-channel audio with an embedded watermark, where the watermark identifies a surround sound encoding process associated with the two-channel audio, detecting the watermark, activating the surround sound matrix decoder 126 if the watermark identifies a surround sound matrix encoding process, and decoding with the active surround sound matrix decoder the two-channel audio into multi-channel audio for playback through a speaker system.

In another embodiment, an apparatus which identifies a surround sound audio technique comprises the watermark encoder 104 to embed a watermark in a multi-channel audio stream, where the watermark identifies a surround sound encoding process associated with the surround sound matrix encoder 108, and the surround sound matrix encoder 108 to encode the multi-channel audio stream with the embedded watermark into a two-channel audio stream.

In another embodiment, an apparatus which remotely enables the surround sound audio decoder 126 comprises the receiver 122 to receive an encoded two-channel audio stream with an embedded watermark, where the watermark identifies a surround sound encoding process associated with the two-channel audio stream, the watermark detector 138 to detect the watermark and to enable the surround sound audio decoder 126 if the watermark identifies the surround sound encoding process associated with the surround sound audio decoder; and the enabled surround sound audio decoder 126 to decode the two-channel audio stream into a multi-channel audio signal.

In another embodiment, an apparatus which remotely enables the enhanced audio decoder 126 comprises the watermark encoder 104 to embed a watermark in a multi-channel audio stream, where the watermark identifies an audio encoding process associated with the enhanced audio encoder 108, and the enhanced audio encoder 108 to encode the multi-channel audio stream with the embedded watermark into a two-channel audio stream.

In another embodiment, an apparatus which remotely enables the enhancement decoder portion of the enhanced audio decoder 126 comprises the receiver 122 to receive an encoded two-channel audio stream with an embedded watermark, where the watermark identifies an audio encoding process associated with the two-channel audio stream, the watermark detector 138 to detect the watermark and to enable the enhancement decoder portion of the enhanced audio decoder 126 if the watermark identifies the audio encoding process associated with the enhanced audio decoder 126, and the enabled enhanced audio decoder to decode the two-channel audio stream.

In another embodiment, a method of identifying a sound enhancement technique in an encoded audio stream comprises enhancing audio with an audio enhancement technique, and incorporating a watermark into the enhanced audio to produce a watermarked audio stream, wherein the watermark identifies the audio enhancement technique.

In another embodiment, a method of identifying a sound enhancement technique in an encoded audio stream comprises receiving an enhanced audio stream with an embedded watermark, where the watermark identifies an audio enhancement process associated with the enhanced audio stream, detecting the watermark, and activating the enhancement decoder portion of the enhanced audio decoder 126 to decode the enhanced audio stream when the detected watermark indicates the enhancement process associated with the enhanced audio decoder 126.

In another embodiment, an apparatus to identify Circle Surround encoded audio comprises a means to embed a watermark in an audio stream indicating the audio stream is a Circle Surround encoded audio stream, and a Circle Surround matrix encoder 108 to encode the audio stream as the Circle Surround encoded audio.

In another embodiment, an apparatus to remotely enable the Circle Surround matrix decoder 126 comprises a receiving means to receive a Circle Surround encoded audio stream with an embedded watermark, where the watermark identifies the audio stream as the Circle Surround encoded audio stream, a means to detect the watermark and a means to activate the Circle Surround matrix decoder 126 to decode the Circle Surround encoded audio stream when the watermark is detected.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A method of identifying a surround sound audio technique in an encoded audio stream, the method comprising:

encoding with a surround sound matrix encoder a first multi-channel audio signal into a first two-channel audio signal, the first multi-channel audio corresponding to audio for a first television commercial, the surround sound matrix encoder comprising a Circle Surround encoder;

encoding with the surround sound matrix encoder a second multi-channel audio signal into a second two-channel audio signal, the second multi-channel audio corresponding to audio for a second television commercial;

embedding a watermark in at least one channel of the first two-channel audio signal to produce a watermarked audio signal, the watermark configured to identify the watermarked audio signal as surround sound matrix encoded audio, the watermark comprising a pattern of data that can be detected by a watermark detector and having a bit rate of at least one bit per three seconds, the watermark being substantially inaudible;

transmitting the watermarked audio signal and the second two-channel audio signal to a watermark detector, the watermark detector configured to:

analyze the watermarked audio signal for a predetermined period of time lasting between approximately 1 millisecond and 3 seconds to detect the watermark;

transmit a first control signal to a matrix decoder in response to detecting the presence of the watermark in the watermarked audio signal, the first control signal indicating the presence of a watermark in the watermarked audio signal;

analyze the second two-channel audio signal for a predetermined period of time lasting between approximately 1 millisecond and 3 seconds to detect the watermark; and transmit a second control signal to the matrix decoder in response to detecting the presence of the watermark in the watermarked audio signal, the second control signal indicating the lack of a watermark in the second two-channel audio signal; and transmitting the watermarked audio signal and the second two-channel audio signal to the matrix detector.

2. The method of claim 1 further comprising storing the two-channel audio signal with the embedded watermark on a storage device for playback at a receiver.

3. A method of identifying a surround sound audio encoding technique in an audio stream comprising:

embedding a watermark in multi-channel audio, wherein the watermark identifies the audio as surround sound matrix encoded audio; and encoding with a surround sound matrix encoder the multi-channel audio having the embedded watermark into two-channel audio.

4. The method of claim 3 further comprising transmitting the two-channel audio with the embedded watermark.

5. The method of claim 3 further comprising storing the two-channel audio with the embedded watermark on a storage device for playback at a receiver.

6. A method of identifying a surround sound audio technique in an encoded audio stream comprising:

receiving two-channel audio with an embedded watermark, wherein the watermark identifies a surround sound audio encoding process associated with the two-channel audio;

detecting the watermark, and activating a surround sound matrix decoder when the watermark identifies a surround sound matrix encoding process; and decoding with the active surround sound matrix decoder the two-channel audio into multi-channel audio for playback through a speaker system.

7. The method of claim 6 wherein the watermark is substantially inaudible.

8. The method of claim 6 further comprising enabling a surround sound indicator when the watermark identifies a surround sound matrix encoding process.

9. An apparatus to identify a surround sound audio technique comprising:

a watermark encoder to embed a watermark in a multi-channel audio stream, wherein the watermark identifies a surround sound encoding process associated with a surround sound matrix encoder; and the surround sound matrix encoder to encode the multi-channel audio stream with the embedded watermark into a two-channel audio stream.

10. The apparatus of claim 9 further comprising a transmitter to transmit the two-channel audio stream.

11. The apparatus of claim 9 further comprising a storage device to store the two-channel audio stream.

12. An apparatus to remotely enable a surround sound audio decoder comprising:

a receiver to receive an encoded two-channel audio stream with an embedded watermark, wherein the watermark identifies a surround sound encoding process associated with the two-channel audio stream;

a watermark detector to detect the watermark and to enable a surround sound audio decoder when the watermark identifies the surround sound encoding process associated with the surround sound audio decoder; and the enabled surround sound audio decoder to decode the two-channel audio stream into a multi-channel audio signal.

13. The apparatus of claim 12 wherein the watermark is substantially inaudible.

14. The apparatus of claim 12 further comprising a surround sound indicator to indicate that the receiver is receiving a surround sound encoded audio signal when the watermark indicates the surround sound encoded audio signal.

15. An apparatus to remotely enable an enhanced audio decoder comprising:

a watermark encoder to embed a watermark in a multi-channel audio stream, wherein the watermark identifies an audio encoding process associated with an enhanced audio encoder; and the enhanced audio encoder to encode the multi-channel audio stream with the embedded watermark into a two-channel audio stream.

16. The apparatus of claim 15 further comprising a transmitter to transmit the two-channel audio stream with the embedded watermark.

17. The apparatus of claim 15 further comprising a storage device to store the two-channel audio stream with the embedded watermark.

18. An apparatus to remotely enable an enhanced audio decoder comprising:

a receiver to receive an encoded two-channel audio stream with an embedded watermark, wherein the watermark identifies an audio encoding process associated with the two-channel audio stream;

a watermark detector to detect the watermark and to enable an enhanced audio decoder when the watermark identifies the audio encoding process associated with the enhanced audio decoder; and the enabled enhanced audio decoder to decode the two-channel audio stream.

19. The apparatus of claim 18 wherein the watermark is substantially inaudible.

20. The apparatus of claim 18 further comprising an enhanced audio indicator to indicate when the receiver receives audio encoded with the encoding process associated with the enhanced audio decoder.

21. A method of identifying a sound enhancement technique in an encoded audio stream comprising:

enhancing audio with an audio enhancement technique; and incorporating a watermark into the enhanced audio to produce a watermarked audio stream, wherein the watermark identifies the audio enhancement technique.

22. The method of claim 21 further comprising transmitting the watermarked audio stream.

23. The method of claim 21 further comprising storing the watermarked audio stream on a storage device.

24. A method of identifying a sound enhancement technique in an encoded audio stream comprising:

receiving an enhanced audio stream with an embedded watermark, wherein the watermark identifies an audio enhancement process associated with the enhanced audio stream;

detecting the watermark; and activating an enhanced audio decoder to decode the enhanced audio stream when the detected watermark indicates the enhancement process associated with the enhanced audio decoder.

25. The method of claim 24 wherein the watermark is substantially inaudible.

26. The method of claim 24 further comprising activating an audio enhancement indicator when the watermark indicates the receiver is receiving the enhanced audio stream.

27. An apparatus to identify Circle Surround encoded audio comprising:

a means to embed a watermark in an audio stream indicating the audio stream is a Circle Surround encoded audio stream; and a Circle Surround matrix encoder to encode the audio stream as the Circle Surround encoded audio.

28. An apparatus to remotely enable a Circle Surround matrix decoder comprising:

a receiving means to receive a Circle Surround encoded audio stream with an embedded watermark, wherein the watermark identifies the audio stream as the Circle Surround encoded audio stream;

a means to detect the watermark; and a means to activate a Circle Surround matrix decoder to decode the Circle Surround encoded audio stream when the watermark is detected.

* * * * *